US007677163B2

(12) United States Patent
Helm

(10) Patent No.: US 7,677,163 B2
(45) Date of Patent: Mar. 16, 2010

(54) COOKING DEVICE WITH A COOKING CHAMBER OUTLET

(75) Inventor: Peter Helm, Wolfenbuttel (DE)

(73) Assignee: MKN Maschinenfabrik Kurt Neubauer GmbH & Co. (DE)

( * ) Notice: Subject to any disclaimer, the term of this patent is extended or adjusted under 35 U.S.C. 154(b) by 824 days.

(21) Appl. No.: 11/415,013

(22) Filed: May 1, 2006

(65) Prior Publication Data

US 2006/0260476 A1 Nov. 23, 2006

(30) Foreign Application Priority Data

Apr. 29, 2005 (EP) ..... 05009414

(51) Int. Cl.
*A23L 1/00* (2006.01)

(52) U.S. Cl. ..... 99/330; 99/476

(58) Field of Classification Search ..... 99/326–333, 99/339, 340, 467, 473–476, 451, 481, DIG. 14; 126/20, 348, 369, 369.1, 369.2, 369.3, 21 A; 219/400, 401, 601, 731, 680–682; 426/241, 426/248, 243, 523

See application file for complete search history.

(56) References Cited

U.S. PATENT DOCUMENTS

| | | | | | |
|---|---|---|---|---|---|
| 3,889,099 | A | * | 6/1975 | Nuss | 219/393 |
| 4,110,916 | A | * | 9/1978 | Bemrose | 34/197 |
| 4,503,760 | A | * | 3/1985 | Pryputsch et al. | 99/447 |
| 4,823,766 | A | * | 4/1989 | Violi | 126/20 |
| 5,029,519 | A | * | 7/1991 | Boyen | 99/341 |
| 5,272,963 | A | * | 12/1993 | Del Fabbro | 99/468 |
| 5,423,248 | A | * | 6/1995 | Smith et al. | 99/443 C |
| 5,481,962 | A | * | 1/1996 | Tedesco | 99/323.4 |
| 5,499,577 | A | * | 3/1996 | Tommasini | 99/476 |
| 5,503,061 | A | * | 4/1996 | Hopkins | 99/357 |
| 5,615,603 | A | * | 4/1997 | Polin | 99/331 |
| 5,690,020 | A | * | 11/1997 | Kitani et al. | 99/470 |
| 5,694,835 | A | * | 12/1997 | Mangina | 99/468 |
| 7,325,481 | B2 | * | 2/2008 | Helm | 99/330 |

FOREIGN PATENT DOCUMENTS

| | | | |
|---|---|---|---|
| DE | 32 15 812 | A1 | 11/1983 |
| DE | 32 15 812 | C2 | 11/1983 |
| DE | 197 30 610 | C1 | 10/1998 |
| DE | 196 51 283 | C2 | 1/2001 |
| DE | 100 17 966 | A1 | 10/2001 |
| DE | 101 09 247 | A1 | 10/2002 |
| DE | 101 62 953 | A1 | 7/2003 |
| DE | 20 2004 000 106 | U1 | 6/2004 |
| DE | 10 2004 006 973 | A1 | 10/2004 |
| DE | 10 2004 001 220 | B3 | 3/2005 |

(Continued)

*Primary Examiner*—Timothy F. Simone
(74) *Attorney, Agent, or Firm*—Salter & Michaelson

(57) ABSTRACT

A cooking device has a cooking chamber as well as a cooking chamber outlet for a fluid. An air trap is provided downstream of the cooking chamber outlet. A device outlet is arranged in turn downstream of the air trap. A water reservoir is located in the air trap. A connection pipe leads from the water reservoir in the air trap into the cooking chamber. Associated with the connection pipe is a transport means, which permits a controllable supply of fluid from the water reservoir in the air trap into the cooking chamber.

21 Claims, 6 Drawing Sheets

FOREIGN PATENT DOCUMENTS

| | | | |
|---|---|---|---|
| DE | 10 2004 001 224 | B3 | 5/2005 |
| EP | 0 892 220 | A1 | 1/1999 |
| EP | 1 103 599 | A1 | 5/2001 |
| EP | 1 209 419 | A2 | 5/2002 |
| EP | 1 364 166 | B1 | 11/2003 |
| FR | 2 849 166 | | 3/2003 |

* cited by examiner

COOKING DEVICE WITH A COOKING CHAMBER OUTLET

FIELD OF THE INVENTION

The present invention relates in general to a cooking device with a cooking chamber and pertains more particularly to a cooking device having a cooking chamber with an outlet for a fluid for cleaning purposes.

BACKGROUND OF THE INVENTION

Cooking devices are used for the preparation of foods. The foods located therein are heated. During this process, vapors or steam or also other fluids are formed, which must be removed. For this reason, a cooking chamber outlet, through which these fluids then pass to a cooking device outlet or waste water connection and are disposed of, is generally located in the base of the cooking chamber of the cooking device.

Such a cooking device with a cooking chamber outlet for a fluid, a device outlet, a water reservoir, a connection pipe from the water reservoir into the cooking chamber, a transport means associated with the connection pipe for the controllable supply of fluid from the water reservoir into the cooking chamber, and a distribution means for the fluid in the cooking chamber is known from the patent document DE 20 2004 000 106 U1, for example.

Moreover, it is necessary that the cooking chamber of cooking devices is regularly cleaned. There have already been a series of proposals to automate this cleaning process as far as possible. The patent documents DE 197 30 610 C1, EP 0 892 220 B1, DE 100 17 966 A1, DE 101 09 247 A1, the subsequently published EP 1 364 166 B1 and DE 20 2004 000 106 U1 describe respective cooking devices, which perform such an automatic cleaning of the cooking chamber and its fittings, i.e. using a circulation-type principle. What the configurations all have in common is that the device outlet is closed by means of a valve or another assembly. A container is thus formed. This container can be the cooking chamber itself, or an additional container can also be arranged in the waste water pipe. If the cooking chamber is to be cleaned in this case, the cooking chamber or the container is filled with a cleaning liquid and the liquid is then distributed in the cooking chamber by means of a circulation pump.

The closed device outlet is then opened again to pass the now used liquid out of the cooking device again.

This process is controlled by means of an electronic device control system for the automatic cleaning.

While this automatic cleaning is indeed quite effective, certain aspects still cause problems therein. This applies in particular to the closing process of the device outlet. For example, if the locking device provided for this should not function as a result of a malfunction or if it is also only partially impaired, then this also compromises the main purpose of the entire cooking device, since the contaminated liquid can no longer exit from the cooking chamber, for example. Then, the entire cooking device can no longer be used, although only an ancillary unit with a subsidiary purpose is affected.

However, at least cleaning is already rendered impossible as a result.

Moreover, the cross-sections of the relevant pipe sections for a closure are relatively large for technical reasons. The diameters generally lie between 30 mm and 70 mm. As a result of this, the appropriate devices for closing these pipes are also quite expensive.

In contrast, it is an object of the present invention to permit an automatic cleaning for such cooking devices with a design that is as simple as possible, but also substantially technically reliable.

SUMMARY OF THE INVENTION

This object is achieved by a cooking device with a cooking chamber, a cooking chamber outlet for a fluid, a device outlet, a water reservoir, a connection pipe from the water reservoir into the cooking chamber, a transport means associated with the connection pipe for the controllable supply of fluid from the water reservoir into the cooking chamber, and a distribution means for the fluid in the cooking chamber, which is distinguished in that an air trap is arranged downstream of the cooking chamber outlet, the device outlet is arranged downstream of the air trap, that the water reservoir lies in the air trap, the connection pipe leads from the water reservoir in the air trap into the cooking chamber, and the transport means for the controllable supply of fluid from the water reservoir into the cooking chamber are arranged so that they convey fluid from the water reservoir in the air trap into the cooking chamber.

The present invention makes use of an element, which is in fact already present in many cooking devices, but serves a quite different purpose here, while not posing any detriment to these other purposes.

Cooking devices with steam generating systems generally have a waste water assembly to connect these to a local waste water network. The condensates and liquids formed during cooking are discharged via this waste water assembly during cooking, as already mentioned above.

In this case, an air trap is occasionally provided in the waste water assembly so that no odors or vapors can exit through this waste water assembly and/or pass into the cooking chamber. Corresponding proposals have already been made in patent document DE 32 15 812 C2 or again in DE 196 51 283 C2. DE 101 09 247 A1 works without such an air trap, for example, thus requiring another type of odor screen. In this case, only a quenching box is connected to the cooking chamber outlet.

An air trap has a water reservoir, which prevents odors or vapors from being able to pass through the assembly.

This existing water reservoir in the air trap is now used according to the present invention as the basic liquid for cleaning. This leads to the surprising result that an additional closure of the cooking chamber outlet or cooking device outlet for instance is no longer necessary. Such a closure can be omitted completely. If one considers that closures used hitherto in practice with their accessories cost some hundreds of dollars and moreover must be painstakingly maintained, the advantage resulting from the invention is clearly evident.

An additional connection pipe is provided, with which the liquid can be brought from the water reservoir into the cooking chamber by means of a transport means. Thus, the above-mentioned disadvantages from the prior art are overcome.

It is particularly preferred that a vapor quenching means for the supply of fresh fluid to the air trap is provided.

Such a system can have a magnetic valve, for example, and a connection to the local water pipe network and can act as a condensation cooling system. The air trap is filled by it when fluid is removed from the water reservoir. However, during the cooking process in the cooking chamber of the cooking device, i.e. during the usual function, such a vapor quenching means restricts the temperature of the water reservoir and thus also of the condensate passing above to a maximum value.

For this, a temperature sensor can be positioned in the water reservoir, which restricts this maximum temperature in association with a controller.

Since the temperature of the water reservoir is limited by this vapor quenching means in the cooking operation, the transport means at the same time protects against any damage as a result of too high a vapor temperature.

It is advantageous if heating elements provided in the cooking chamber are also directly used to heat the cleaning fluid. This can be achieved by a skilful arrangement and utilisation of the distribution means.

Moreover, it is preferred to provide a transport means associated with the air trap, which conveys fluid from the water reservoir in the air trap to the waste water connection.

With such a transport means, e.g. a circulation pump and/or lifting pump, the content of the air trap can be conveyed to the cooking device outlet and thus additionally the water exchange can be assisted in the water reservoir.

In a preferred embodiment, the transport means associated with the air trap and with the connection pipe are identical. Therefore, the very same pump can be used for both purposes.

It is additionally preferred that the transport means are pumps. Such pumps are particularly suitable as transport for the desired purpose.

In addition, it is preferred that a controllable junction is provided in the connection pipe, from which a branch pipe leads to the device outlet. So-called evacuation pumps, centrifugal pumps and also other types of pumps can be used. It is favourable if larger particles can also be transported in order to transport the content of the air trap into the device outlet. Sieves can also be appropriate in specific cases.

If the pump fails, then the cooking chamber can still be rinsed with fresh water and then dried, and then used for its main purpose, namely cooking food materials. Therefore, it is readily possible to continue to cater for a festive occasion or a dinner in a restaurant with the cooking device and wait for the alerted repair service to come the next day, which can be very important economically.

In this case, for the practical application case, a switchover 2/3-way valve can be used, for example, which is positioned behind the transport means in the connection pipe, and thus effects a selective transport of the fluid from the air trap either into the cooking chamber or into the cooking device outlet.

Moreover, it is preferred if a supply means for fresh water into the cooking chamber is provided.

It is particularly preferred in this case if the supply means has a nozzle in the cooking chamber for distribution of the fresh water.

It is provided in an embodiment that the distribution means for the fluid in the cooking chamber has a nozzle at the end of the connection pipe in the cooking chamber, which undertakes distribution of the fluid conveyed from the air trap in the cooking chamber. Moreover, the fan wheel frequently located in the cooking chamber can also be added to assist the distribution means, and thus can achieve a good distribution of the cleaning fluid in the entire cooking chamber.

Moreover, the cleaning function is properly fulfilled particularly when supply means are provided for cleaning and/or clear rinsing agents into the cooking chamber or to the supply means for the fresh water into the cooking chamber or into the connection pipe from the air trap into the cooking chamber or into the air trap.

Finally it is preferred if a separating element is arranged in the air trap, which separates a region of the air trap, in which coarse particles are deposited, from an extraction region of the air trap for the transport means. This prevents coarse contaminating particles such as crumbs from being entrained with the conveyed fluid into the cooking chamber again. Instead, they lie ready to be easily conveyed to the waste water connection.

DESCRIPTION OF THE DRAWINGS

Some embodiments of the invention are described in more detail below on the basis of the drawing.

DETAILED DESCRIPTION

Figure 1:
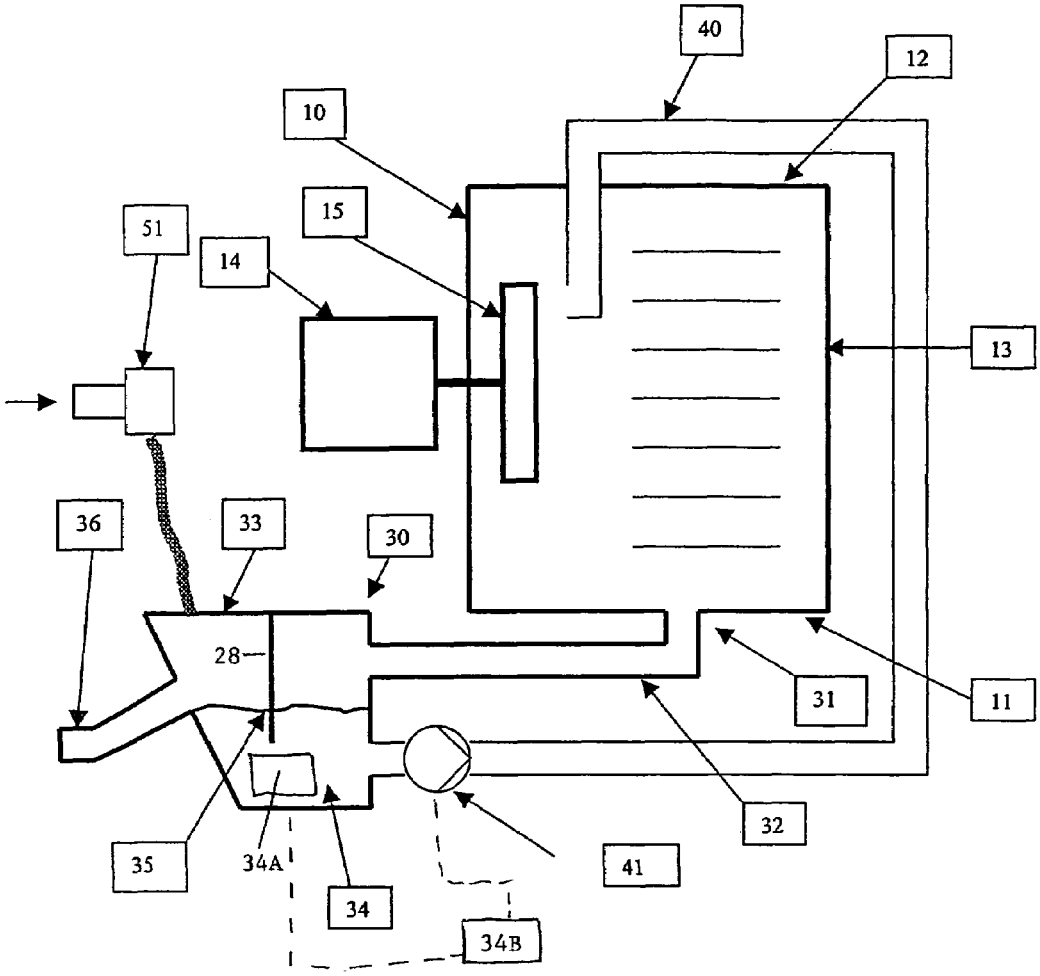
FIG. 1 is a schematic representation of a first embodiment of the invention.

A first embodiment of a complete assembly according to the invention is shown schematically in FIG. 1. This shows a cooking device with a cooking chamber 10. The cooking chamber 10 has a base 11, an upper side 12 and a side wall 13. The details have been omitted here.

In this embodiment, a circulation system 14 for the cooking chamber 10 is located on one side wall 13 of the cooking chamber 10. The circulation system 14 has a motor and a fan wheel 15 located inside the cooking chamber 10.

FIG. 1 also shows a waste water assembly, i.e. an outflow system 30 for a fluid, which has formed in the cooking chamber 10. This outflow system 30 begins with a cooking chamber outlet 31 in the base 11 of the cooking chamber 10. A pipe 32 leads out of the cooking chamber outlet 31 on to an air trap 33.

A water reservoir 34 is located in the air trap. The surface or water level of this water reservoir 34 in the air trap 33 is also referred to as the water line 35.

Finally, a pipe leads from the air trap 33 to the cooking device outlet 36 and also forms the waste water connection to the local waste water network.

The water level or water line 35 reaches as far as the outlet level in the air trap 33 into the pipe to the cooking device outlet 36.

In the paragraph depicted in FIG. 1, the air trap 33 includes the vertical wall 28 that extends downwardly from the top wall of the housing. It is noted that the bottom end of wall 28 extends below the water line 35. Therefore, the air above the water line 35 is divided into two parts on the left and right of the wall 28. In this way air cannot move from the left to the right in the air trap as long as the water line 35 is sufficiently high to reach the vertical wall 28. Similarly, the bottom end of wall 28 extends below the point where the water level drains from the water reservoir as is clear from FIG. 1.

A vapor quenching means 51 leads into the air trap 33. The vapor quenching means 51 also serves as a condensation cooling system and has a connection to the local water pipe network, so that cool fresh water can be supplied and as a result the temperature of the water reservoir 34 in the air trap 33 can be restricted to a legally permissible maximum value. This also restricts the temperature of the waste water in the cooking device outlet 36.

A temperature sensor 34A is arranged in the water reservoir 34 of the air trap 33 for this purpose, which in conjunction with a controller 34B effects this temperature restriction.

A connection pipe 40 now leads into the cooking chamber 10 from the air trap 33 or, more particularly out of its lower area in the water reservoir 34. The connection pipe 40 terminates in the vicinity of the fan wheel 15 of the circulating air system 14 in the shown and also preferred embodiment.

A transport means 41 is provided, which conducts a fluid, i.e. the liquid present in the water reservoir 34 in particular, out of the air trap 33 into the cooking chamber 10 and, as mentioned, into the vicinity of the fan wheel 15. This transport means 41 is preferably a circulation pump. Since the temperature of the water reservoir 34 is also restricted to a maximum value during the cooking operation of the cooking device, the pump or the transport means 41 is protected from too high a vapor temperature.

If during the cleaning process a part of the liquid is removed from the water reservoir 34 in the air trap 33 by the transport means 41, the water line 35 would actually drop accordingly. The automatic cleaning control system can be provided for this, so that the filling means associated with the vapor quenching means 51 now also operate after the transport means 41 has been switched on and feed fresh water into the air trap 33 here during the cleaning process. This simultaneously ensures that the odor lock out function of the air trap 33 can also remain assured without change as the water level 35 is maintained above the bottom end of wall 35. At the same time, it can thus also be ensured that any overflow integrated into the air trap is further blocked with the water reservoir 34 and prevents steam and possibly also any foam formed during cleaning to exit there.

During the normal cooking operation of the arrangement from FIG. 1, the transport means 41 is inactive. The air trap 33 is filled as far as the water line 35 and thus fulfils the odor lock out function. If waste water is formed during the cooking operation, then the vapor quenching means 51 cools this condensate or these vapors and at the same time also holds the air trap 33 constantly at the same filling level. There is no flow in the connection pipe 40 and nothing exits at its end.

If a cleaning operation is performed now after the cooking operation has ended, then firstly water is fed into the entire system by means of the vapor quenching means 51 or through further means still to be described in association with the following figures, and thus exchanges the liquid in the air trap 33. Solid constituents or also fats and oils are frequently deposited and held here during the cooking operation. These are discharged in this way.

At this point in time or also with a slight time shift, the transport means 41, e.g. the circulation pump, can also be switched on to achieve a better mix of the liquid in the air trap 33 and thus promote the exchange of the liquid. After a certain time, the liquid in the water reservoir 34 in the air trap 33 is sufficiently pure. If the transport means 41 is not yet in operation, it is now switched on, while fresh water is preferably further supplied by means of the vapor quenching means 51 or other structural elements to counteract the drop in the water line 35 of the water reservoir 34 in the air trap 33.

The transport means 41 conveys the liquid through the connection pipe 40 into the cooking chamber 10 and, in the embodiment shown in FIG. 1, into the vicinity of the fan wheel 15 of the circulating air system 14.

In this case, a cleaning agent can also be introduced into the transported liquid. There are several possibilities for this, which are not illustrated here in detail. Thus, liquid cleaning agents, for example, can be fed into the connection pipe 40 by means of pumps or valves, which are actuated accordingly by the device control system 34B. A further possibility lies in the use of cleaning tabs or other additional devices and containers such as are known, for example, from EP 1 209 419 A2 or EP 1 103 599 A1.

The rotating fan wheel 15 now directs the liquid discharging from the connection pipe 40, in particular together with the cleaning fluid contained therein or simultaneously supplied thereto, into the cooking chamber 10. As a result of this, the inside wall and the installation parts in the cooking chamber 10 are cleaned by the action of the cleaner and the impinging liquid.

The liquid ultimately collects on the base 11 of the cooking chamber 10 and runs via the cooking chamber outlet 31 in the base 11 through the pipe 32 again to the air trap 33.

This process is preferably performed at a cooking chamber temperature of between 40° C. and 100° C., since this elevated temperature improves the cleaning action.

There is also the possibility during the cleaning process to replace part of the cleaning liquid by means of the vapor quenching means 51 or by other means, and possibly introduce a new cleaner into the circulation, which is produced by the transport means 41 and is formed via the connection pipe 40, the cooking chamber 10, the cooking chamber outlet 31, the pipe 32 and the air trap 33.

The additional introduction of a new cleaner is of particular advantage in the case of heavily soiled cooking chambers 10.

After a certain time the cleaning process is ended. There is now the possibility of also performing a clear rinsing process. This is not essential for the cleaning process, but is often preferred in order to neutralise the alkalinity of the cleaning agent by means of the acid of the clear rinsing agent, so that a lime-free and optically particularly pleasing cooking chamber 10 result.

For this process the contents of the air trap 33 are rinsed out again by means of the vapor quenching means 51 and/or the transport means 41 to now remove the cleaner or dilute the contents of the air trap 33 accordingly. By supplying water, the cleaning fluid runs together with the deposits removed from the cooking chamber 10 to the cooking device outlet 36 and on into the local waste water network.

If after a certain time the liquid in the air trap 33 is replaced by fresh water, then a further circulation process can start, in which either the mentioned clear rinsing process is initiated or, if necessary, a further cleaning process can additionally occur.

In the clear rinsing process, the procedure is substantially the same as the cleaning process, but a clear rinsing agent is supplied instead of the cleaning agent.

At the end of the clear rinsing step, the liquid in the air trap 33 is exchanged again to free the cooking chamber 10 as far as possible of any clear rinsing agent now contained therein. However, during this process the temperature is lowered sufficiently to ensure that the temperature of the circulated liquid does not exceed 50° C., where possible, to avoid lime deposits in the water, which could optically obscure the cooking chamber 10.

At the end of all the cleaning processes, a vaporising step can also be provided in the automatic cleaning, for example, to also remove any remaining residues of clear rinsing agent or also detergent residues. This is very effective in particular in cooking devices with a steam generation system in the cooking chamber, since possibilities are readily provided there to feed water in liquid form into the cooking chamber and vaporise it.

Finally, a drying process can also be provided in the cooking chamber 10.

Figure 2:
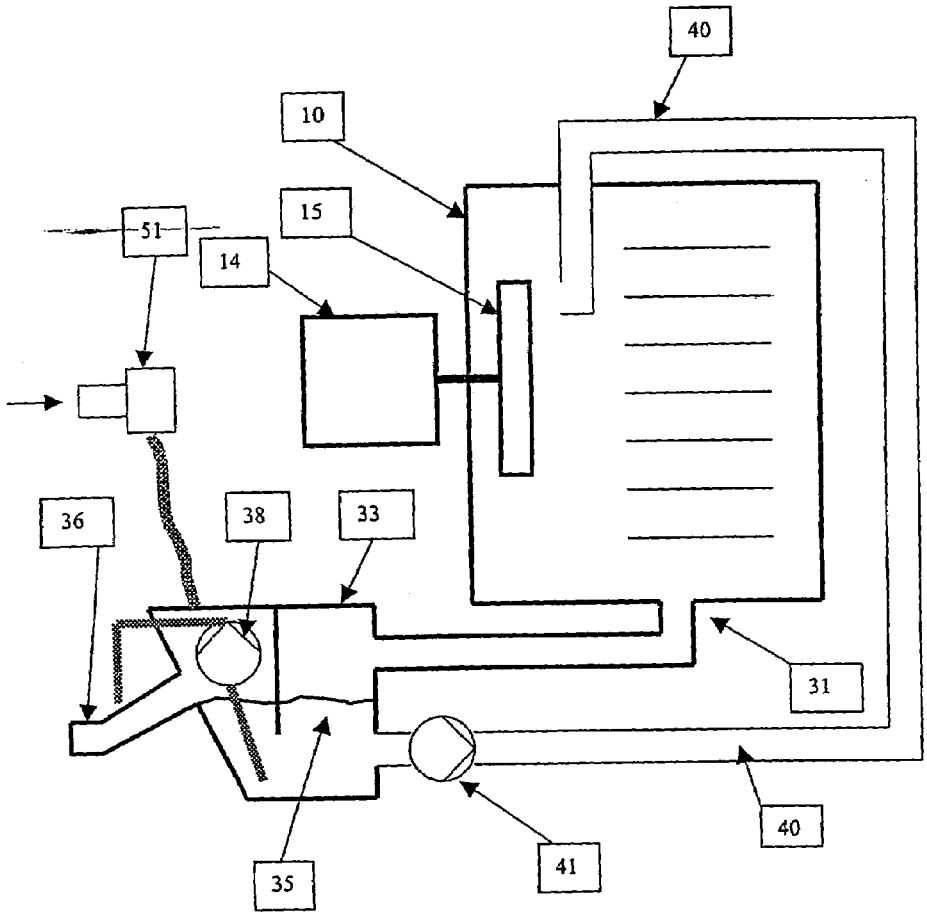
FIG. 2 is a schematic representation of a second embodiment of the invention.

FIG. 2 shows an embodiment of the invention, which contains a few additional features. Here, a second transport means 38 is additionally provided, in particular a lifting pump. This can be a relatively small pump. This pump can assist the transport of the content of the air trap 33 to the cooking device outlet 36. In this case, the pump or transport means 38 can be arranged either inside the air trap 33, as shown in FIG. 2, or can also be arranged outside the air trap. This enables the content of the air trap 33 to be discharged more quickly.

Figure 3:
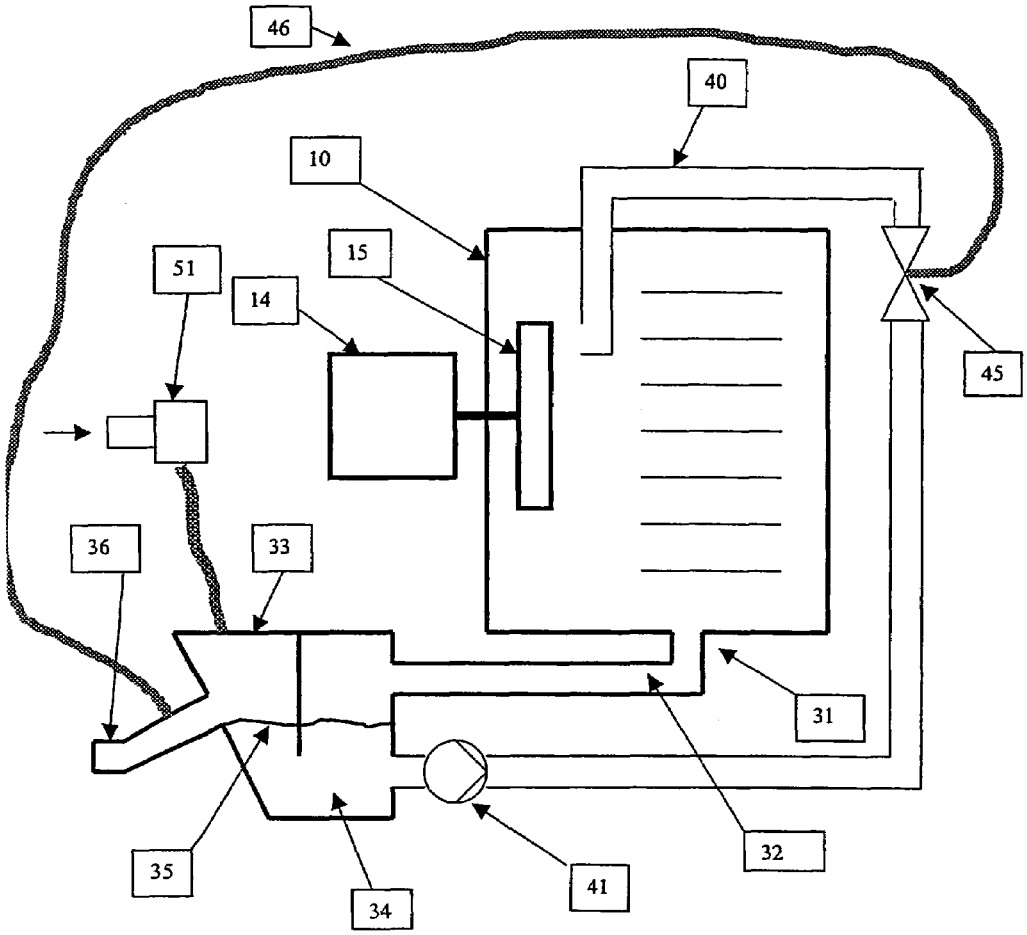
FIG. 3 is a schematic representation of a third embodiment of the invention.

FIG. 3 shows an additional possibility. Here, as a supplement to the embodiment in FIG. 1, it is provided that a junction 45 is also arranged in the connection pipe 40. This junction 45 can be provided with a 3/2-way valve, for example. From the junction 45, a branch pipe 46 leads to the cooking device outlet 36. This means that, through a suitable control means at the junction 45, the water conveyed in the connection pipe 40 or the liquid there is either transported further into the cooking chamber 10 or is transported directly to the cooking device outlet 36 via the branch pipe 46. As a result, the two transport means 38 and 41 can be provided by one and the same pump or other means.

Figure 4:
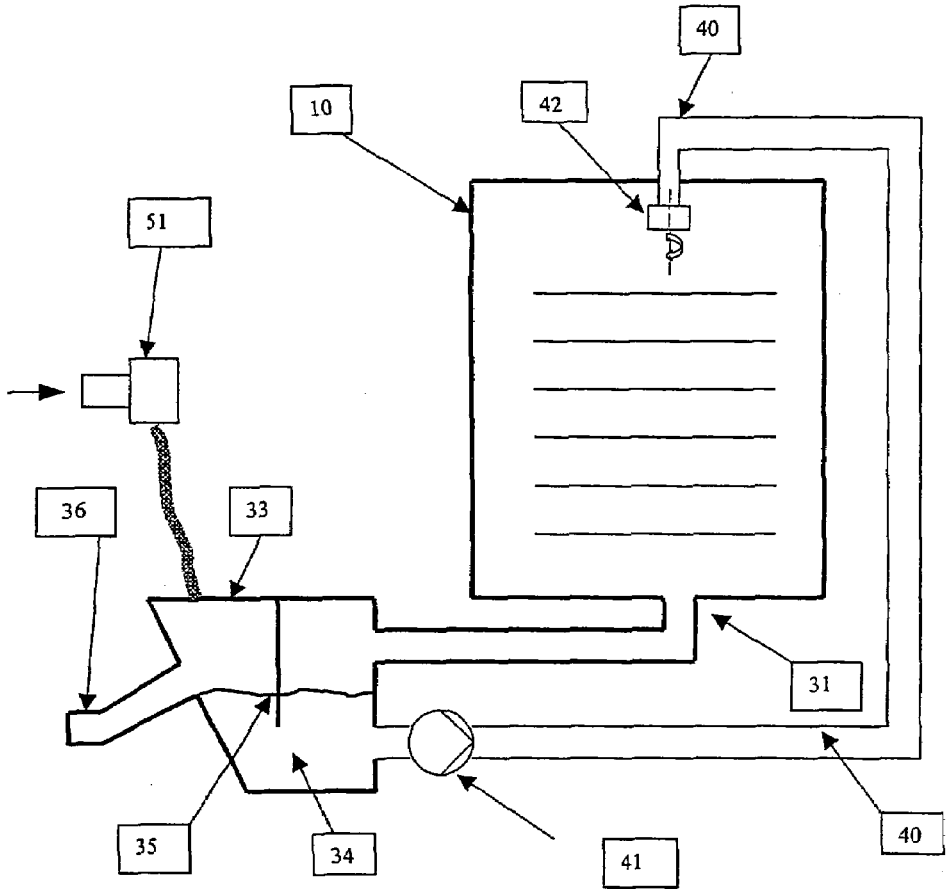
FIG. 4 is a schematic representation of a fourth embodiment of the invention.

FIG. 4 shows a further variant of the embodiment from FIG. 1. FIG. 4 shows that the connection pipe 40 is not arranged in the vicinity of the fan wheel 15 of the circulating air system 14, but independently has a nozzle 42 at its end in the cooking chamber 10. The liquid from the air trap 33 is thus fed into the cooking chamber 10 via this flushing nozzle 42. A rotating nozzle is shown here in FIG. 4. One or more such nozzles 42 flushing the cooking chamber 10 can also be provided.

In this case, the nozzle 42 can be caused to rotate either by the pressure of the transport means 41, i.e. through the pump pressure, or also by outlet nozzles suitably arranged with respect to flow, and/or can also be motor-driven. The cleaning performance can be further increased by such flushing nozzles.

It is then possible to also use such an embodiment in cooking devices, which do not have a circulating air system 14 and a fan wheel 15, however these can also be additionally present.

Figure 5:
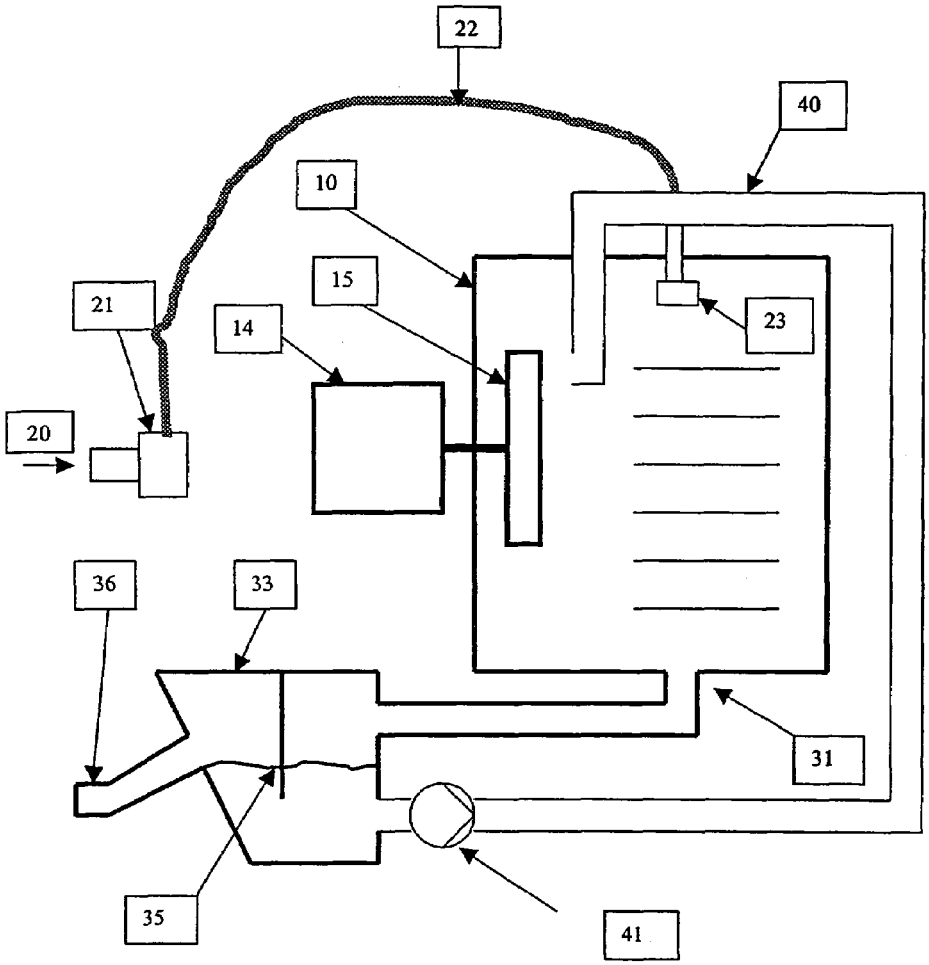
FIG. 5 is a schematic representation of a fifth embodiment of the invention.

FIG. 5 shows a further alternative possibility, again with a circulating air system 14 and a fan wheel 15. However, another combination of the different features from the embodiments is also possible.

In FIG. 5 a supply means 20 is additionally provided for a fluid into the cooking chamber 10. The supply means 20 has a valve 21 for the fluid to allow the supply to be controlled via controller 34B. The fluid passes via a pipe 22 to a nozzle 23 in the upper area, i.e. adjacent to the upper side 12, of the cooking chamber 10. A plurality of nozzles 23 can also be provided here.

Various cooking devices already have systems for feeding water into the cooking chamber 10 in order to generate steam there by means of the prevailing cooking chamber temperature. In such cooking devices, these systems for feeding water can also be used as supply means 20 to supply water for cleaning purposes.

The supply means 20 can be used alternatively or in addition to the vapor quenching means 51 to feed water into the system, which via the connection pipe 40 consists of the cooking chamber 10, the cooking chamber outlet 31, the pipe 32 and the air trap 33, for the cleaning process. This water can contribute to the exchange of the water in the air trap 33 and hold the water line 35 at the desired level. This applies to both the actual cleaning processes and the rinsing processes.

Figure 6:
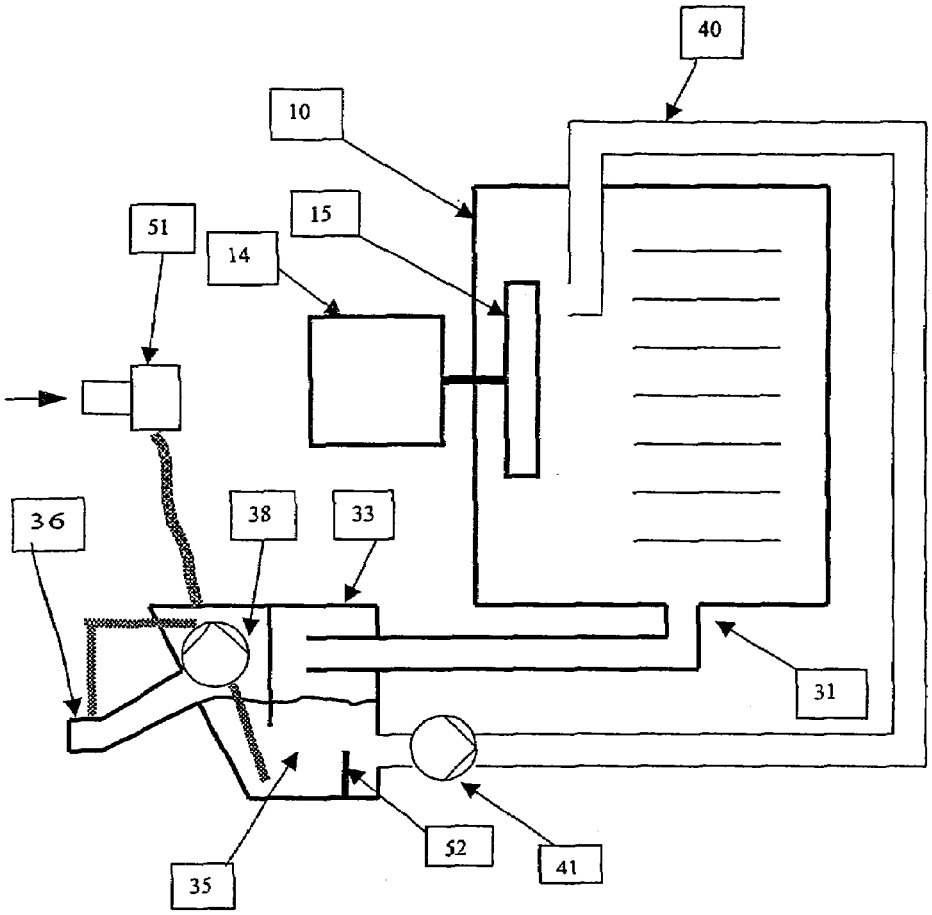
FIG. 6 is a schematic representation of a sixth embodiment of the invention

FIG. 6 shows a further embodiment. The element 52 is a separating element, wall or plate, which is attached to the base of the air trap 33 so that particles of the cooking process, which are heavier than water and are brought into the air trap 33 via the pipe 32, are deposited on the base of the air trap in a region, to the left of element 52, which does not directly adjoin the output region to the pump 41. As a result, the particles are not passed through the pump 41 into the cooking chamber 10. The pump 38 can transport these particles to the waste water connection during emptying of the air trap into the device outlet 36.

However, the separating element 52 does not divide the air trap 33 completely, but leaves some passages free so that the air trap can be emptied completely. The height of the separating element 52 is lower than the usual water level 35 in the air trap 33. The arrangement and operation of the different pumps enable the respectively undesirable contaminants to be pumped out of the air trap 33 into the device outlet 36, so that fluid is constantly available in the water reservoir in the air trap, which is also suitable for the cleaning process and which can also be supplemented after the currently proceeding segment of the cleaning process with appropriately acid or base added elements.

The individual process steps can all be performed by an automatic system such as the controller 34B shown only in FIG. 1. This controls in each case whether the air trap is filled, whether it is rinsed, whether the fluid in the cooking chamber should be heated or not, whether additives are respectively added to the fluid, and which additives, whether cleaning fluid is pumped, or whether rinsing or clear rinsing is performed. Finally, there are also stages provided, which automatically perform a drying operation using hot air in the cooking chamber.

LIST OF REFERENCE NUMBERS

10 cooking chamber
11 base of the cooking chamber
12 upper side of the cooking chamber
13 side wall of the cooking chamber
14 circulation system for the cooking chamber
15 fan wheel of the circulation system
20 supply means for a fluid into the cooking chamber
21 valve for the supply means
22 pipe of the supply means
23 nozzle of the supply means in the cooking chamber
30 outflow system for the fluid from the cooking chamber
31 cooking chamber outlet in the base of the cooking chamber
32 pipe from the cooking chamber outlet to an air trap
33 air trap
34 water reservoir in the air trap
34A temperature sensor
34B controller
35 water line of the water reservoir
36 device outlet or waste water connection
38 transport means
39 transport means associated with the air trap
40 connection pipe from the air trap into the cooking chamber
41 transport means associated with the connection pipe
42 nozzle at the end of the connection pipe
45 junction
46 branch pipe
51 vapor quenching means
52 separating element

The invention claimed is:

1. A cooking device comprising:

a cooking chamber having a cooking chamber outlet for a fluid and a cooking chamber inlet;

an air trap, which is arranged downstream of the cooking chamber outlet;

a device outlet, which is arranged downstream of the air trap;

said air trap including a water reservoir, the water level in the water reservoir referred to as a water line;

an upright wall that extends below the water line and divides the water reservoir into separate parts to prevent air from passing through the air trap;

a connection pipe that leads from the water reservoir of the air trap to the cooking chamber inlet of the cooking chamber;

a transport pump means that conveys the liquid present in the water reservoir out of the air trap, through the connection pipe and into the cooking chamber; and a distribution means for the fluid in the cooking chamber.

2. The cooking device of claim 1, including a vapor quenching means provided for the supply of fresh fluid to the air trap.

3. The cooking device of claim 1, including a second transport pump means associated with the air trap which transports the fluid from the water reservoir in the air trap to the device outlet or a waste water connection.

4. The cooking device of claim 3, wherein both of the transport pump means associated with the air trap and with the connection pipe are substantially the same.

5. The cooking device of claim 1 wherein the transport pump means comprises a circulation pump.

6. The cooking device of claim 1 including a controllable junction in the connection pipe, from which a branch pipe leads to the device outlet.

7. The cooking device according to claim 1 including a water supply means for providing fresh water into the cooking chamber.

8. The cooking device according to claim 7, wherein the water supply means has a nozzle in the cooking chamber for distribution of the fresh water.

9. The cooking device according to claim 1, wherein the distribution means for the fluid in the cooking chamber has a nozzle at the end of the connection pipe in the cooking chamber, which performs the distribution of the fluid conveyed from the air trap in the cooking chamber.

10. The cooking device according to claim 1 including supply means for a cleaning and/or clear rinsing agent into the cooking chamber.

11. The cooking device according to claim 1, characterised in that there is provided in the air trap a separating element, which separates a region of the air trap, in which coarse particles are deposited, from an extraction region of the air trap, for the transport pump means.

12. A cooking device comprising:

a cooking chamber having an outlet for a fluid and a cooking chamber inlet;

an air trap which is arranged downstream of the cooking chamber outlet;

said air trap including a water reservoir;

a device outlet, which is arranged downstream of the air trap;

an upright wall that is disposed in the water reservoir to prevent air from passing through the air trap;

an outlet pipe from the outlet of said cooking chamber to said air trap for draining fluid from said cooking chamber to said air trap;

a connection pipe that leads from said water reservoir to the cooking chamber inlet of said cooking chamber;

and a circulation pump that conveys the liquid present in the water reservoir out of the air trap, though the connection pipe and into the cooking chamber.

13. The cooking device of claim 12 further including a vapor quenching means for the supply of fresh fluid to the water reservoir.

14. The cooking device of claim 13 wherein the outlet from the chamber is at the bottom of the chamber and the connection pipe couples to the chamber at a location above the cooking chamber outlet.

15. The cooking device of claim 14 further including a controller for controlling said circulation pump and a temperature sensor for sensing the temperature of the water in the water reservoir.

16. The cooking device of claim 15 wherein said upright wall has a bottom end that is adapted to extend below the normal water line in a water reservoir.

17. The cooking device of claim 12 wherein said upright wall has a bottom end that is adapted to extend below the normal water line in the water reservoir.

18. The cooking device of claim 12 including a separating wall at the bottom of the water reservoir adjacent to a water outlet of the reservoir, said outlet pipe extending over said separating wall so that course particles are deposited on a side of the separating wall remote from the water outlet.

19. The cooking device of claim 12 further including a distribution means for the fluid in the cooking chamber.

20. The cooking device of claim 12 further including a controller for controlling the circulation pump and a vapor quenching means provided for the supply of fresh fluid to the air trap, the controller controlling both the circulation pump and the vapor quenching means during a cleaning cycle to circulate fluid through the cooking chamber while replenishing fluid in the water reservoir to maintain the desired water level.

21. The cooking device of claim 12 wherein the cooking chamber inlet is disposed at a bottom wall of the cooking chamber, the cooking chamber outlet is disposed at a top wall of the cooking chamber, the water reservoir has an outlet to which the outlet pipe connects and an inlet to which the connection pipe connects with the inlet disposed over the outlet, said water reservoir defining at said device outlet a water line, said upright wall extending from a top wall of the reservoir and below the water line to separate the water reservoir into separate parts, one part having the inlet and outlet of the reservoir and the other part having the device outlet.

* * * * *